US006416346B1

(12) United States Patent
Nakamura

(10) Patent No.: US 6,416,346 B1
(45) Date of Patent: Jul. 9, 2002

(54) CONNECTOR

(75) Inventor: Hideto Nakamura, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/559,103

(22) Filed: Apr. 27, 2000

(30) Foreign Application Priority Data

Apr. 28, 1999 (JP) ..... 11-122439

(51) Int. Cl.[7] ..... H01R 13/64
(52) U.S. Cl. ..... 439/374; 439/681
(58) Field of Search ..... 439/374, 680, 439/681

(56) References Cited

U.S. PATENT DOCUMENTS

| | | | | |
|---|---|---|---|---|
| 4,376,565 A | | 3/1983 | Bird et al. | |
| 4,711,509 A | | 12/1987 | Cross et al. | |
| 4,913,665 A | | 4/1990 | Sacksen | |
| 4,986,769 A | * | 1/1991 | Adams, III et al. | 439/681 |
| 5,282,757 A | * | 2/1994 | Maeda | 439/374 |
| 5,399,045 A | | 3/1995 | Yoneda et al. | |
| 5,613,881 A | * | 3/1997 | Ichida et al. | 439/680 |
| 5,816,842 A | * | 10/1998 | Thantrakul et al. | 439/374 |
| 5,890,931 A | | 4/1999 | Ittah et al. | |
| 6,027,364 A | * | 2/2000 | Fukuda | 439/489 |
| 6,159,054 A | * | 12/2000 | Ko | 439/680 |
| 6,165,024 A | * | 12/2000 | Ko | 439/680 |
| 6,168,475 B1 | * | 1/2001 | Ko | 439/680 |

FOREIGN PATENT DOCUMENTS

| | | |
|---|---|---|
| EP | 392 629 B1 | 7/1996 |
| EP | 676 828 B1 | 6/2000 |

* cited by examiner

*Primary Examiner*—P. Austin Bradley
*Assistant Examiner*—Edwin A. León
(74) *Attorney, Agent, or Firm*—Banner & Witcoff, Ltd.

(57) ABSTRACT

A male housing 20 has a large hood member 21 surrounding a male terminal housing 21 which houses male terminal fittings 31. A female housing 10 has a small hood member 13 surrounding a female terminal housing 11 which houses female terminal fittings. This small hood member 13 fits between the male terminal housing 21 and the large hood member 23. Four ribs 40 protrude outwards from an upper side and a lower side of an outer circumference face of the small hood member 13, these ribs 40 being located at positions near corners. Grooves are formed in an inner circumference face of the large hood member 23 at locations corresponding to the ribs 40, the ribs 40 being insertable tightly therein. The arrangement prevents a male and a female housing from being fitted together in a misaligned manner.

20 Claims, 4 Drawing Sheets

CONNECTOR

TECHNICAL FIELD

The present invention relates to an improved electrical connector, for preventing male and female housings from being fitted in a misaligned manner.

BACKGROUND OF THE INVENTION

An example of a conventional waterproof connector is described in JP-6-5150. As shown in FIG. 7 of this specification, this connector has a female housing 4 provided with a large hood member 3 surrounding a female terminal housing 2 which houses female terminal fittings 1, and a male housing 8 having a small hood member 7 provided at an anterior face of a male terminal housing 6 which houses male terminal fittings 5. Tabs 5A of the male terminal fittings 5 protrude in an anterior direction. When a sealing ring 9 is in a fitted state around an outer circumference of the female terminal housing 2, the small hood member 7 of the male housing 8 fits within the large hood member 3 of the female housing 4. The sealing ring 9 is pressed between the small hood member 7 and the female terminal housing 2, a seal thereby being maintained between the two housings 4 and 8.

In other words, a waterproof connector is usually configured so as to have a large hood member 3 on the female housing 4, and to have a small hood member 7 on the male housing 8, this small hood member 7 fitting between the large hood member 3 and the female terminal housing 2.

However, when such female and male housings 4 and 8 are fitted together, the male housing 8 may be fitted in a state whereby the male housing 8 is inclined relative to the female housing 4. That is, fitting may occur in a misaligned state. In that case, one edge of the small hood member 7 enters the large hood member 3 first. Conventional connectors, as in the example described above, have a configuration whereby the small hood member 7 of the male housing 8 fits between the female terminal housing 2 and the large hood member 3 of the female housing 4. As a result of this configuration, an initial misaligning of position will correct itself naturally as fitting progresses. Consequently, not much misalignment occurs during fitting. At most, either the housing 4 or the housing 8 needs to be provided with ribs and grooves to prevent upside-down fitting.

However, there may be cases where the male and female housings need to be reversed from the conventional example. In that case, as shown in schematic form in FIG. 8 (A), of this specification, a male housing d and a female housing g are provided. The male housing d has a large hood member c surrounding a male terminal housing b which houses male terminal fittings, tabs a of these male terminal fittings protruding in an anterior direction. The female housing g has a small hood member f surrounding a female terminal housing e which houses female terminal fittings. This small hood member f fits between the male terminal housing b and the large hood member c.

In this type of connector, the position of the small hood member f of the female housing g which is fitted within the large hood member c is not corrected when the two housings d and g are fitted together. Consequently, as shown in FIG. 8(B), the small hood member f can be fitted in an inclined position. In particular, when the hood members c and f are approximately rectangular, and longer sides of the small hood member f are angled so that both ends thereof are misaligned in an anterior-posterior direction, the end which is misaligned at the anterior of the small hood member f (the left end in FIG. 8(B), can easily enter deeply into the large hood member c and strike against the tabs a of the male terminal fittings which are protruding within this large hood member c, thereby causing them to change shape.

Moreover, there are non-waterproof connectors in which a female housing is fitted into a hood member of a male housing. However, in this type of connector as well, if the female housing is fitted in an inclined state, an end of longer sides of this female housing can enter deeply into the hood member and may interfere with the tabs of the male terminal fittings.

The present invention has taken the above problem into consideration, and aims to present a connector in which the misaligning of female and male housings is prevented when these are being fitted together.

SUMMARY OF THE INVENTION

According to the invention there is provided an electrical connector comprising a male housing and a female housing, the male housing having protruding male terminals and a surrounding male hood, and the female housing having female terminals adapted to receive the male terminals, the female housing being adapted to be closely received within said male hood in a fitting direction, characterised in that the female housing has external ribs extending in said fitting direction, and the male hood has corresponding grooves on the interior thereof, said ribs and grooves interengaging on mutual fitting of the male and female housings, and the female housing having four sides, said ribs being distributed around the female housing adjacent the ends of said sides.

Such an arrangement ensures that the protruding ribs contact the mouth of the male hood, and prevent damage to the male terminals by restricting the degree of misaligned insertion.

In a preferred embodiment the female housing is substantially rectangular in transverse section, the ribs being located adjacent the corners, which may be rounded. In this embodiment the ribs extend in two mutually opposite directions.

Alternatively, the female housing may be circular, and the ribs may be equi-spaced around the periphery thereof.

The female housing may have a hood for close fitting insertion into the male hood, and the ribs may be provided on the periphery of the female hood. In this embodiment a waterproofing seal is preferably provided between a female hood and the male housing when the housings are fully engaged.

The male connector may include a resilient cantilever arm latchable with a projection of the female housing.

In a preferred embodiment the arm is movable into a recess of the male housing, this recess being shielded from the mouth of the male hood in order to prevent the size thereof being unduly increased. The recess is preferably an outwardly extending portion of the male housing, and is shielded by a portion of the male hood.

BRIEF DESCRIPTION OF DRAWINGS

Other features of the invention will be apparent from the following description of a preferred embodiment, shown by way of example only in the accompanying drawings in which.

DESCRIPTION OF PREFERRED EMBODIMENTS

An embodiment of the present invention is described below with the aid of FIGS. 1 to 6.

Figure 1:
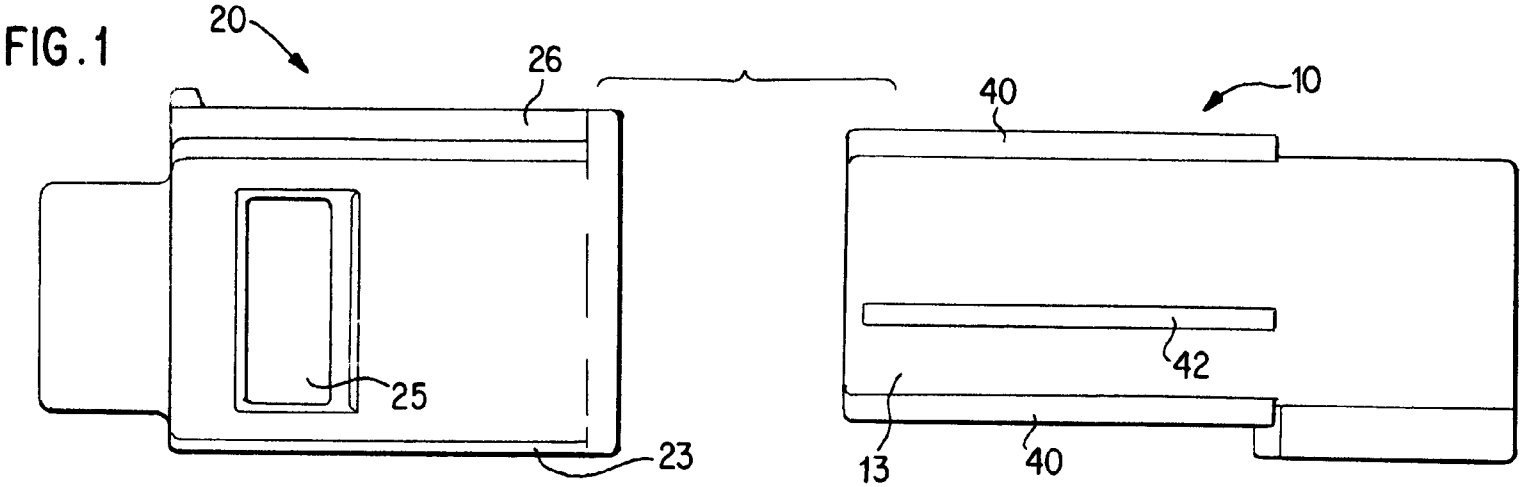
FIG. 1 is a side face view of female and male housings of an embodiment of the present invention, prior to being fitted together.
Figure 3:
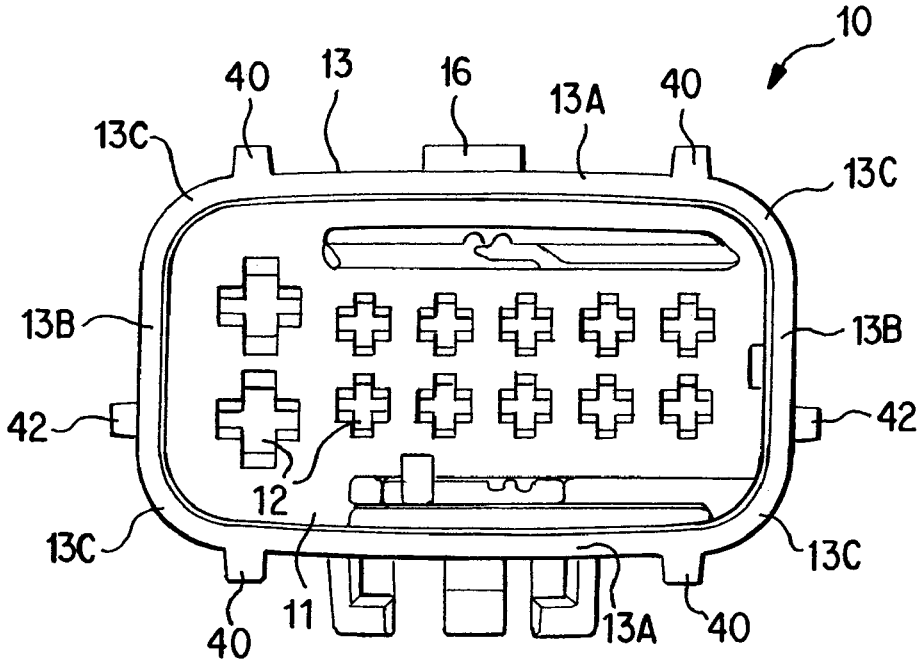
FIG. 3 is a front view of the female housing.

The present embodiment uses a waterproof connector as an example. As shown in FIGS. 1 and 3, this connector is provided with a female connector housing 10 and a male connector housing 20.

The fitting side of each housing will hereafter be referred to as the anterior thereof.

Figure 2:
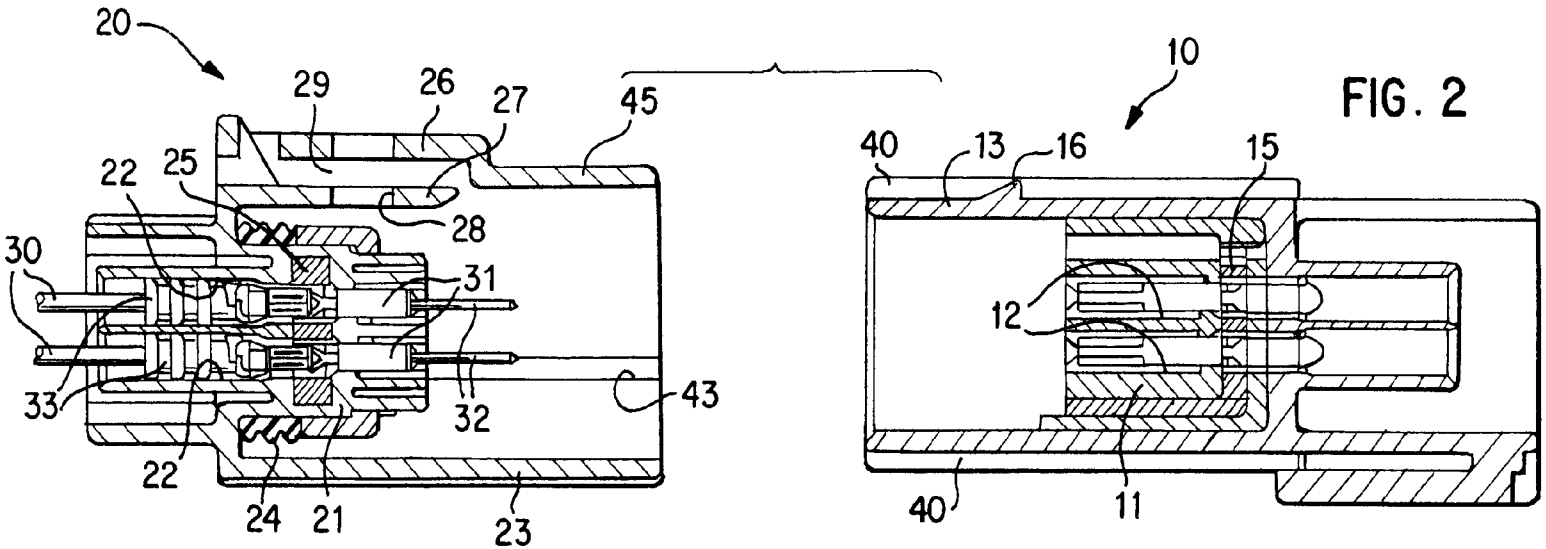
FIG. 2 is a vertical cross-sectional view of FIG. 1.

The female housing 10 shown on the right in FIGS. 1 and 2 is provided with a female terminal housing member 11, and a plurality of cavities 12 provided therein in an aligned manner form two rows, an upper and a lower row. A small hood member 13 surrounds an anterior face of the female terminal housing member 11. As shown in FIG. 3, this small hood member 13 has an oblong tubular shape. Upper and lower sides 13A thereof are arc-like with a large radius of curvature, left and right sides 13B thereof are straight and four corners 13C thereof are also arc-like with a small radius of curvature.

Female terminal fittings )not shown), which have ends of electrical wires fixed thereto, are inserted from a posterior direction into the cavities 12 of the female terminal housing member 11 and are doubly stopped by a retainer 15 which is inserted laterally. Waterproofing rubber stoppers are fixed to posterior ends of the female terminal fittings, these covering the openings of the cavities 12 and thereby waterproofing them.

A locking protrusion 16 is formed on an upper face of the small hood member 13 at a central portion thereof in a width-wise direction. This locking protrusion 16 is provided at a location slightly to the anterior of the anterior face of the female terminal housing member 11.

The male housing 20 is provided with a male terminal housing member 21. Cavities 22 are mutually aligned therein, the number of cavities being the same as the number of cavities of the female housing 10. The small hood member 13 of the female housing 10 fits with the outer sides of the male terminal housing member 21. Further, a large hood member 23 extends in an anterior direction along outer sides of the male terminal housing member 21 from an approximately central position thereof in a length-wise direction. A specified amount of space in this large hood member 23 is open. This large hood member 23 is cylindrical and is larger than the small hood member 13 of the female housing 10, the small hood member 13 fitting tightly within the inner circumference thereof.

A sealing ring 24 fits around the outer circumference of the male terminal housing member 21 at a location near the innermost end of the large hood member 23.

Male terminal fittings 31, which have ends of electrical wires 30 fixed thereto, are inserted into the cavities 22 of the male terminal housing member 21 in a state whereby tabs 32 of these male terminal fittings 31 protrude into the large hood member 23. These male terminal fittings 31 are doubly stopped by a retainer 25 which is inserted laterally. This retainer 25 also has the function of holding the sealing ring 24 in an unremovable state. Furthermore, waterproofing rubber stoppers 33 are fixed to posterior ends of the male terminal fittings 31, these covering the openings of the cavities 22 and thereby waterproofing them.

A convex member 26 is formed on an upper face of the large hood member 23 at a central portion thereof in a width-wise direction, this convex member 26 protruding outwards for a specified distance. A plate-shaped locking arm 27 extends from an innermost face of an interior side of the convex member 26, this locking arm 27 being provided at an approximately central location within this convex member 26 and extending in an anterior direction. This locking arm 27 makes sliding contact with the upper face of the small hood member 13 of the female housing 10. A locking hole 28 opens into the locking arm 27 at a location close to the tip thereof, the locking protrusion 16 fitting therein.

Figure 4:
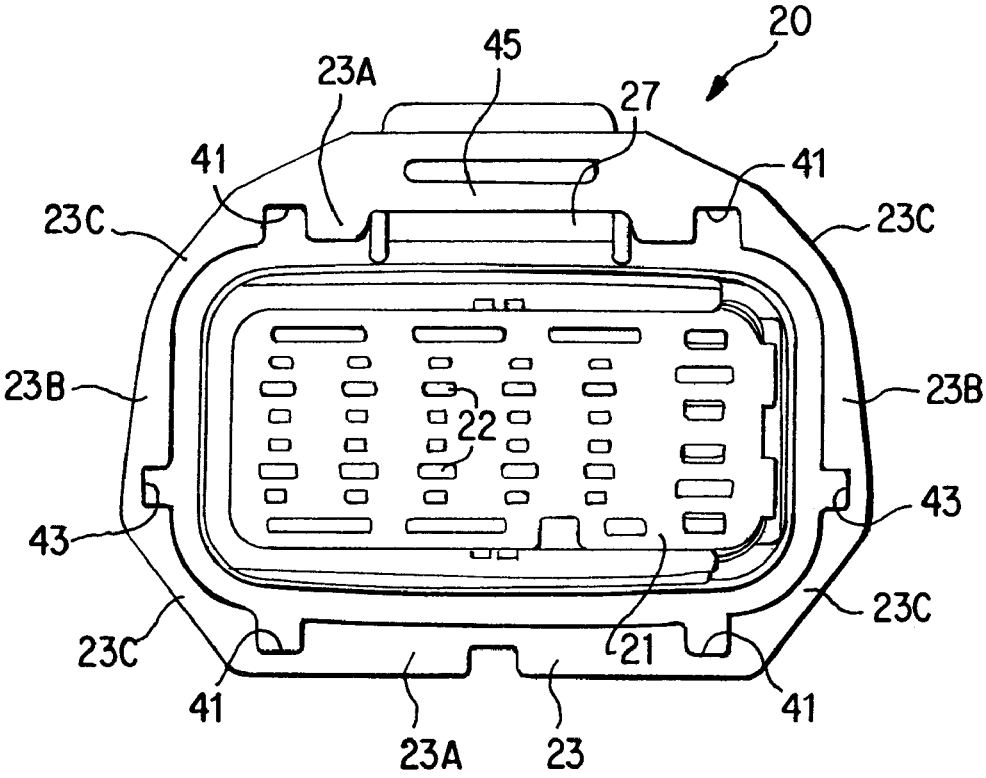
FIG. 4 is a front view of the male housing.

Four ribs protrude outwards from an outer circumference face of the small hood member 13 of the female housing 10. These ribs 40 extend in an anterior-posterior direction and extend along the entire length of the outer circumference face. As shown in FIG. 3, these ribs 40 protrude upwards and downwards from the upper side 13A and the lower side 13A respectively, from the portions which join with the rounded corners 13C. Furthermore, four grooves 41 are formed in an inner circumference face of the large hood member 23 of the male housing 20. The ribs 40 are inserted relatively tightly therein. As a result, as shown in FIG. 4, the grooves 41 are formed at locations where an upper side 23A and a lower side 23A are joined by means of rounded corners 23C, these grooves facing upwards and downwards respectively.

Auxiliary ribs 42 are formed on an outer circumference face of left and right sides 13B of the small hood member 13, these auxiliary ribs 42 being formed at a prescribed distance below the centre of these left and right sides 13B. As shown in FIG. 1, these auxiliary ribs 42 extend from a location slightly behind the anterior edge of the small hood member 13, and extend along approximately the entire length thereof.

Auxiliary grooves 43 are formed in an inner circumference face of left and right sides 23B of the large hood member 23 of the male housing 20. These auxiliary grooves 43 are formed at a prescribed distance below the centre of these left and right sides 23B. The auxiliary ribs 42 are inserted relatively tightly therein.

In addition, a concave member 45 extends from the location of the convex member 26 of the large hood member 23 of the male housing 20. This concave member 45 extends from the tip of the locking arm 27 to the fitting face of the male housing 20. A base face of the concave member 45 approaches the vicinity of the upper face of the locking arm 27.

The configuration of the present embodiment is as described above. Next, the operation thereof will be explained.

When the female and male housings 10 and 20 are fitted together, the small hood member 13 of the female housing 10 is pushed into the interior of the large hood member 23 of the male housing 20 and fits therein. At this juncture, if the female housing 10 is, for example, fitted in a position whereby it is upside-down, the position of the left and right auxiliary ribs 42 will not correspond with the position of the auxiliary grooves 43 in the large hood member 23 of the male housing 20. As a result, the auxiliary ribs 42 stroke against the anterior end face of the large hood member 23, and fitting cannot occur.

Figure 5:
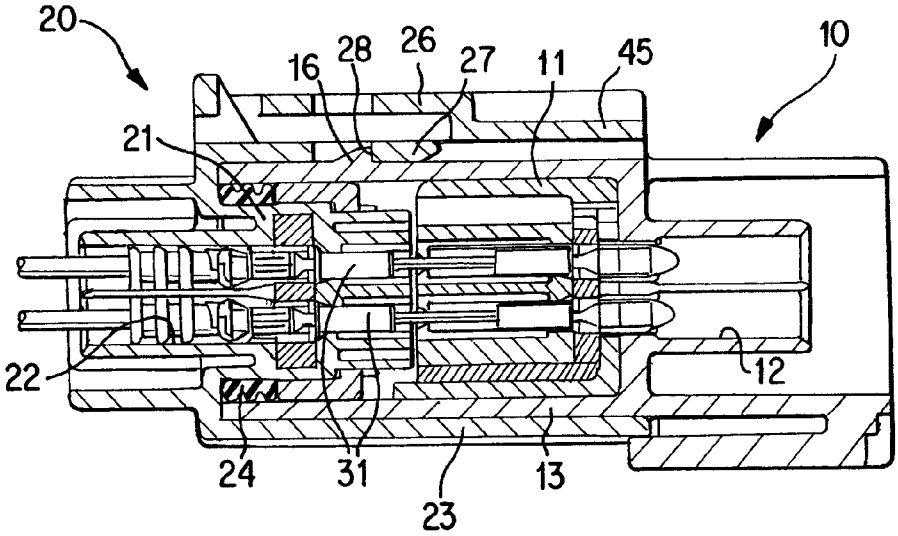
FIG. 5 is a vertical cross-sectional view showing the female and male housings in a correctly fitted state.
Figure 7:
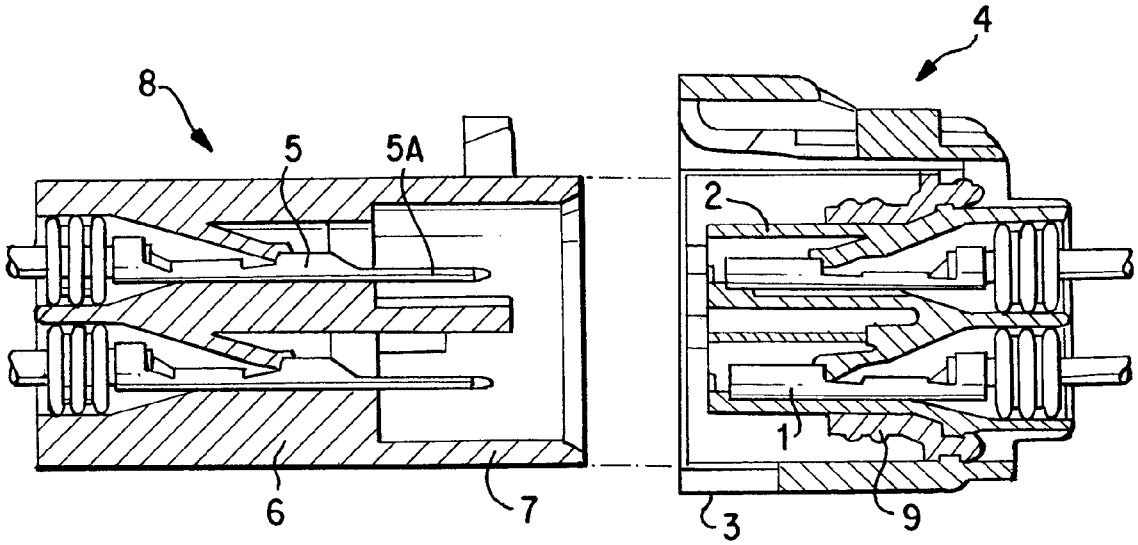
FIG. 7 PRIOR ART
FIG. 7 is a cross-sectional view of a prior art example.

If the two housings 10 and 20 are in the correct position and are fitted along the same axis, the ribs 40 and the auxiliary ribs 42 of the female housing 10 move along and enter into the grooves 41 and the auxiliary grooves 43 of the male housing 20, and the small hood member 13 of the female housing 10 is pushed into the interior of the large hood member 23 of the male housing 20. As this pushing-in occurs, the tip of the locking arm 27 approaches the locking protrusion 16. Consequently, the locking arm 27 bends upwards as the pushing-in continues, and the female housing 10 is pushed in until the anterior edge of the small hood member 13 reaches the correct position at the innermost end within the large hood member 23. At this juncture, the locking protrusion 16 reaches the locking hole 28 in the locking arm 27. Consequently, as shown in FIG. 5, the locking arm 27 returns resiliently to its original position and the locking protrusion 16 fits into the locking hole 28, thereby locking the two housings 10 and 20 in a correctly fitted state.

Furthermore, the sealing ring 24 attached around the base portion of the male terminal housing member 21 is gripped resiliently between this male terminal housing member 21 and the anterior tip of the small hood member 13, thereby sealing the two housings 10 and 20.

However, if the fitting portions of the two housings 10 and 20 cannot be seen clearly and the fitting operation is performed by touch, the two housings 10 and 20 may be fitted together in a misaligned state.

Figure 6A:
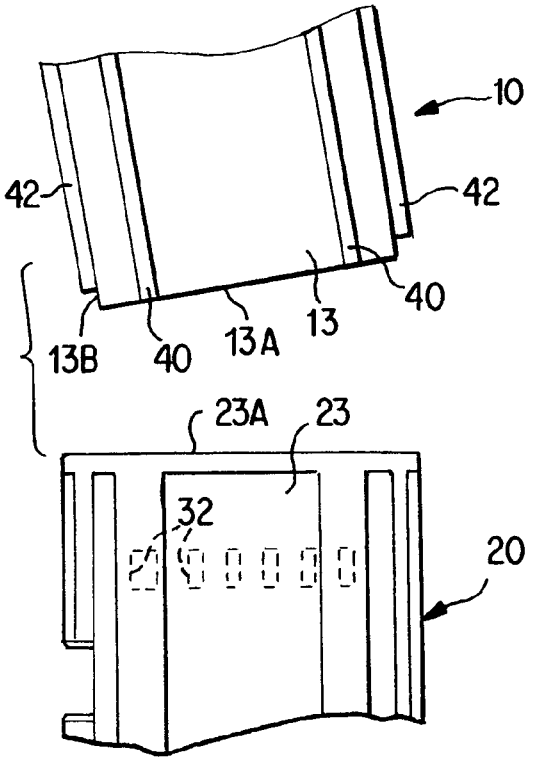
FIG. 6 is an explanatory drawing showing a case where misaligned fitting has occurred.
Figure 8A:
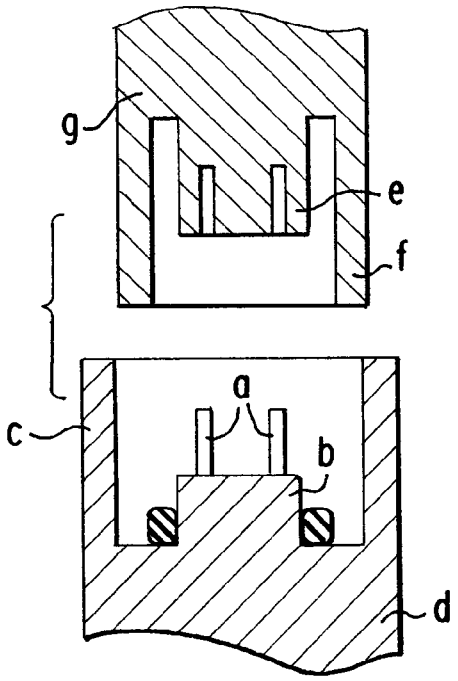
FIG. 8A PRIOR ART
FIG. 8 is an explanatory drawing showing a case where misaligned fitting has occurred in the prior art example.

For example, as shown in FIG. 6(A), if the female housing 10 is fitted in a state where it has been inclined in a counter-clockwise direction (relative to FIG. 6(A), the shorter side 13B on the left side of the small hood member 13 in FIG. 6(A) would enter into the large hood member 23 if the ribs 40 were not provided.

Figure 6B:
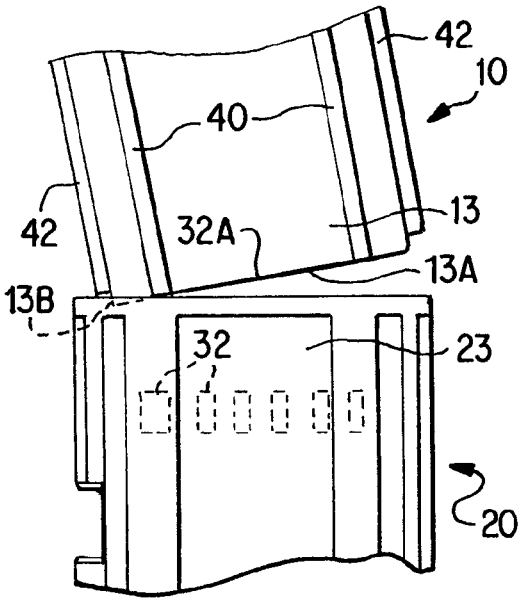
Figure 8B:
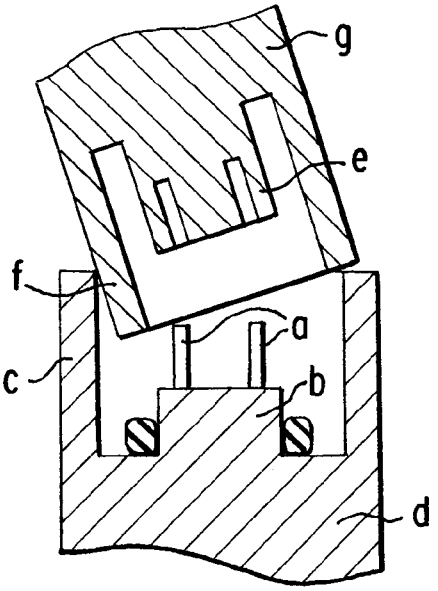
FIG. 8B PRIOR ART

However, the upper side 13A and the lower side 13A of the small hood member 13 are each provided with the pair of ribs 40. Consequently, as shown in FIG. 6(B), the upper and lower ribs 40 on the left side will strike against the anterior face of the longer side 23A of the corresponding large hood member 23 in such a case of misaligned fitting, thereby allowing the shorter side 13B on the left of the small hood member 13 to enter only a short distance.

Conversely, if the female housing 10 is fitted in a state where it has been inclined in a clockwise direction and fitting in this misaligned state were attempted, the upper and lower ribs 40 on the right side will strike against the anterior face of the longer side 23A of the corresponding large hood member 23, thereby allowing the lower side 13A on the right side of the small hood member 13 to enter only a short distance.

An explanation follows as to why the four ribs 40 of the female housing 10 are made to protrude upwards or downwards at locations where the upper side 13A and lower side 13A of the small hood member 13 join with the rounded corners 13C.

If the left and right ribs 40 in FIG. 6 were provided at a location close to the central portion in a width-wise direction, and the female housing 10 were to be fitted in a state whereby it had been inverted in an anticlockwise direction, the shorter side 13B on the left of the small hood member 13 could enter relatively deeply into the large hood member 23 before the left rib 40 would strike against the anterior face of the longer side 23A of this large hood member 23. Consequently, providing the ribs 40 in the vicinity of both ends of the longer sides 13A allows these ribs 40 to strike sooner against longer sides 23A of the large hood member 23, and effectively controls entry therein.

In this manner, if the ribs 40 were merely required to strike quickly against the longer sides 23A of the large hood member 23, the most effective location for these ribs 40 is at both ends of the longer sides 13A of the small hood member 13, that is, at the corners 13C. However, the corners 13C are rounded so as to ensure that the sealing ring 24, which extends along the entire circumference of the small hood member 13, can be gripped reliably. As a result, if the ribs 40 were to protrude at right angles from outer faces of these corners 13C, the ribs 40 might enter into the corners 23C of the large hood member 23 if there were a slight vertical misalignment of the female housing 10.

In other words, in order to ensure that the ribs 40 make contact with the longer sides 23A of the large hood member 23 in the case where there is a slight vertical misalignment of the female housing 10, it is necessary to determine the distance along which the ribs 40 protrude at right angles from the upper side 13A or the lower side 13A of the small hood member 13. Given that the ribs 40 protrude from the upper side 13A and the lower side 13A of the small hood member 13 by a certain amount, if the ribs 40 were to protrude instead from the rounded corners 13C, they would have to have a greater height compared to the case where they are provided on the upper and lower sides 13A. Consequently these ribs 40 would be weaker and, particularly in the case whereby the ribs 40 protrude perpendicularly from the corners 13C, the outer form of the female housing 10 would increase in size.

That is, particularly in the case where the small hood member 13 is fitted in an inclined state with the left and right shorter sides 13B misaligned in an anterior-posterior direction, the ribs 40 will strike quickly against the longer side 23A of the corresponding large hood member 23 instead of one of these shorter sides 13B entering deeply into the large hood member 23. Furthermore, the ribs 40 will strike against the longer side 23A of the large hood member 23 no matter how greatly the small hood member 13 is misaligned in a vertical direction. Moreover, the ribs 40 protrude respectively upwards or downwards from four locations in the upper side 13A and the lower side 13A, from the portions thereof which join with the rounded corners 13C. As a result, a prescribed protruding distance can be obtained, thereby ensuring the strength of the ribs 40 and preventing the female housing 10 from increasing in size.

In addition, when the small hood member 13 is fitted in an inclined state with the upper and lower longer sides 13A misaligned in an anterior-posterior direction, one of these longer sides 13A may enter into the large hood member 23. However, the distance which it can enter will be shallow and therefore no ribs are provided near the two edges of the shorter sides 13B.

Consequently, if the small hood member 13 is square or almost square in shape, ribs should be provided near both ends of all four sides.

In certain cases, misaligned fitting may occur when the corner 13B of the small hood member 13 is inserted into the convex member 26 of the large hood member 23. However, the concave member 45 is provided within the convex member 26, this concave member 45 covering, in a sense, the fitting side of the convex member 26. Consequently, the small hood member 13 of the female housing 10 will strike against an anterior wall of the concave member, thereby preventing the small hood member 13 from entering the convex member 26 inadvertently.

In the present embodiment as described above, if the small hood member 13 of the female housing 10 is inserted in a misaligned state into the large hood member 23 of the male housing 20, the ribs 40 strike against the anterior face of the large hood member 23, thereby preventing the anterior edge of the small hood member 13 from entering deeply therein. As a result, the anterior edge of the small hood member 13 does not strike against the tabs 32 of the male terminal fittings 31. Damage thereto is thereby prevented.

Furthermore, the present invention is not limited to the embodiments described above with the aid of figures. The present invention may be embodied in various other ways without deviating from the scope of the accompanying claims. For example, the possibilities described below also lie within the technical range of the present invention.

(1) In contrast to the present invention, the ribs may equally well be provided on the inner circumference face of the large hood member of the male housing, and the grooves may be provided in the outer circumference face of the small hood member of the female housing.

(2) A circular hood member would also be appropriate to the present invention. In that case, a plurality of sets of ribs and grooves (as many as possible) should be provided along the circumference thereof. If at least four sets of ribs and grooves are provided thereamong at equidistant intervals, misaligned fitting will reliably be prevented.

(3) The present invention is equally suitable for a non-waterproof connector in which a female housing is fitted within a hood member of a male housing.

What is claimed is:

1. An electrical connector comprising a male housing and a female housing, the male housing having a tubular portion with a seal thereabout, male terminals protruding from the tubular portion, and a surrounding male hood about the male terminals to receive the female housing, and the female housing having female terminals to receive the male terminals and a female hood to receive the tubular portion of the male housing and be closely received within said male hood in a fitting direction, wherein the seal engages in a sealing relationship between the female hood and the tubular portion when the housings are fully fitted together, wherein the female housing has external ribs extending in said fitting direction to a free end of the female hood, and the male hood has corresponding grooves on the interior thereof, said ribs and grooves interengaging on mutual fitting of the male and female housings, and the ribs engaging the male hood when the female housing is misaligned to prevent substantial insertion of the female hood into the male hood and thereby prevent the female hood from contacting the male terminals, and wherein the female housing has four sides and rounded corners in a plane perpendicular to the fitting direction, said ribs being distributed around the female housing adjacent the rounded corners and on at least one pair of opposite sides, and at least one rib being positioned to prevent inverting the female housing relative to the male housing during fitting of the housings together.

2. An electrical connector according to claim 1 wherein said ribs are directed in one of two mutually opposite directions.

3. An electrical connector according to claim 1 and further including an additional rib and corresponding groove, the additional rib and groove permitting a single fitting orientation of the male and female housings.

4. An electrical connector to claim 1 wherein the female housing has a female hood engageable within said male hood, said ribs being, provided on the outer circumference of said female hood, and a sealing ring being provided in use between said female hood and said male housing.

5. An electrical connector according to claim 1 wherein said female housing is substantially rectangular in a plane perpendicular to the fitting direction, said ribs being located adjacent the ends of the longer rectangular sides.

6. An electrical connector according to claim 5, wherein said ribs are located adjacent said rounded corners.

7. An electrical connector according to claim 6 wherein said ribs are located at a respective transition between the straight edge of said female housing and a rounded corner.

8. An electrical connector according to claim 1, wherein said ribs are located adjacent said rounded corners.

9. An electrical connector according to claim 8 wherein said ribs are located at a respective transition between the straight edge of said female housing and a rounded corner.

10. An electrical connector according to claim 1 wherein said female housing has a protrusion from the outer periphery thereof, and said male housing having a resilient cantilever latching arm protruding in the fitting direction, said latching arm having an aperture adapted to receive said protrusion on fitted engagement of said male and female housings wherein said latching arm is movable into a recess of said male housing, said recess being shielded from said female housing.

11. An electrical connector according to claim 10 wherein said recess is shielded by a wall portion of said male hood.

12. An electrical connector according to claim 10 wherein said recess comprises an outwardly extending wall portion of said male housing.

13. An electrical connector according to claim 12 wherein said recess is shielded by a wall portion of said male hood.

14. An electrical connector comprising a male housing and a female housing, the male housing having protruding male terminals, a tubular portion with a seal thereabout, and a surrounding cylindrical male hood about the male terminals to receive the female housing, and the female housing having female terminals to receive the male terminals and a female hood to receive the tubular portion of the male housing and be closely received within said male hood in a fitting direction, wherein the seal engages in a sealing relationship between the female hood and the tubular portion when the housings are fully fitted together, and wherein the female housing has external ribs extending in said fitting direction to a free end of the female hood, and the cylindrical male hood has corresponding grooves on the interior thereof said ribs and grooves interengaging on mutual fitting of the male and female housings, and the ribs engaging the male hood when the female housing is misaligned to prevent substantial insertion of the female hood into the male hood and thereby prevent the female hood from contacting the male terminals, said ribs being equi-spaced around the periphery of the female housing, and the female housing has rounded corners in a plane perpendicular to the fitting direction, at least one rib being positioned to prevent inverting the female housing relative to the male housing during fitting of the housings together.

15. An electrical connector according to claim 14 and further including an additional rib and corresponding groove, the additional rib and groove permitting a single fitting orientation of the male and female housings.

16. An electrical connector to claim 14 wherein the finale housing has a female hood engageable within said male hood, said ribs being provided on the outer circumference of said female hood, and a sealing ring being provided in use between said female hood and said male housing.

17. An electrical connector according to claim 14 wherein said female housing has a protrusion from the outer periphery thereof, and said male housing having a resilient cantilever latching arm protruding in the fitting direction, said latching arm having an aperture adapted to receive said protrusion on fitted engagement of said male and female housings wherein said latching arm is movable into a recess of said male housing, said recess being shielded from said female housing.

18. An electrical connector according to claim 17 wherein said recess is shielded by a wall portion of said male hood.

19. An electrical connector according to claim 17 wherein said recess comprises an outwardly extending wall portion of said male housing.

20. An electrical connector according to claim 19 wherein said recess is shielded by a wall portion of said male hood.

* * * * *

UNITED STATES PATENT AND TRADEMARK OFFICE

CERTIFICATE OF CORRECTION

PATENT NO. : 6,416,346 B1
DATED : July 9, 2002
INVENTOR(S) : Hideto Nakamura

It is certified that error appears in the above-identified patent and that said Letters Patent is hereby corrected as shown below:

Column 9,
Line 3, change “finale” to -- female --.

Signed and Sealed this

Twenty-seventh Day of August, 2002

*Attest:*

*Attesting Officer*

JAMES E. ROGAN
*Director of the United States Patent and Trademark Office*